US011073118B2

(12) United States Patent
Ito et al.

(10) Patent No.: US 11,073,118 B2
(45) Date of Patent: Jul. 27, 2021

(54) FUEL PUMP AND FUEL PUMP MODULE

(71) Applicant: DENSO CORPORATION, Kariya (JP)

(72) Inventors: Satoshi Ito, Kariya (JP); Daiji Furuhashi, Kariya (JP); Yuuji Hidaka, Kariya (JP); Hiromi Sakai, Kariya (JP)

(73) Assignee: DENSO CORPORATION, Kariya (JP)

( * ) Notice: Subject to any disclaimer, the term of this patent is extended or adjusted under 35 U.S.C. 154(b) by 463 days.

(21) Appl. No.: 15/776,491

(22) PCT Filed: Nov. 25, 2016

(86) PCT No.: PCT/JP2016/084870
§ 371 (c)(1),
(2) Date: May 16, 2018

(87) PCT Pub. No.: WO2017/104375
PCT Pub. Date: Jun. 22, 2017

(65) Prior Publication Data

US 2018/0347526 A1 Dec. 6, 2018

(30) Foreign Application Priority Data

Dec. 17, 2015 (JP) ..... JP2015-246454

(51) Int. Cl.
*F02M 37/10* (2006.01)
*F02M 37/50* (2019.01)
(Continued)

(52) U.S. Cl.
CPC ..... *F02M 37/10* (2013.01); *F02M 37/44* (2019.01); *F02M 37/50* (2019.01); *F04C 2/102* (2013.01);
(Continued)

(58) Field of Classification Search
None
See application file for complete search history.

(56) References Cited

U.S. PATENT DOCUMENTS 1,493,612 A * 5/1924 Denison ..... B67D 7/68 417/423.3
1,677,118 A * 7/1928 Ford ..... B01D 29/23 210/457
(Continued)

FOREIGN PATENT DOCUMENTS

JP 11-280666 10/1999
JP 2011-074865 4/2011
(Continued)

*Primary Examiner* — Robert J Popovics
(74) *Attorney, Agent, or Firm* — Nixon & Vanderhye P.C.

(57) ABSTRACT

A fuel pump is connected to a suction filter which is provided with a filter connecting portion having a cylindrical hole and a projecting portion protruding radially inward from an inner peripheral wall of the cylindrical hole. The fuel pump suctions the fuel filtered by the suction filter. The fuel pump is provided with a suction port having multiple suction openings at a side of the suction filter so as to suction the fuel therethrough, and a pump connecting portion provided at outer side of the multiple suction openings and connected with the filter connecting portion. The pump connecting portion has an outer peripheral wall of which outer shape corresponds with a shape of the inner peripheral wall, and a dent portion denting inward from the outer peripheral wall, which the projecting portion is engaged with.

6 Claims, 7 Drawing Sheets

(51) Int. Cl.
*F04C 2/10* (2006.01)
*F04C 15/06* (2006.01)
*F04C 13/00* (2006.01)
*F02M 37/44* (2019.01)

(52) U.S. Cl.
CPC ..... *F04C 13/008* (2013.01); *F04C 15/06* (2013.01); *F04C 2210/203* (2013.01)

(56) References Cited

U.S. PATENT DOCUMENTS 2,370,590 A * 2/1945 Taylor ..... F02M 37/10 222/333
2,937,755 A * 5/1960 Szwargulski ..... B01D 39/083 210/172.3
3,294,025 A * 12/1966 Niemeyer ..... F04D 13/086 210/416.4
3,875,059 A * 4/1975 Maschino ..... B01D 35/26 210/172.3
3,910,464 A * 10/1975 Schlanzky ..... F04D 29/605 222/180
4,312,753 A * 1/1982 Bell ..... B01D 35/0273 210/250
4,420,396 A * 12/1983 Yamamoto ..... B01D 29/15 210/416.4
4,546,750 A * 10/1985 Brunell ..... B60K 15/077 123/514
4,569,637 A * 2/1986 Tuckey ..... F02M 37/08 417/360
4,617,121 A * 10/1986 Yokoyama ..... B01D 29/15 210/416.4
4,684,463 A * 8/1987 Mizusawa ..... B01D 35/0273 210/172.3
4,694,857 A * 9/1987 Harris ..... F02M 37/106 137/565.24
4,747,388 A * 5/1988 Tuckey ..... B60K 15/077 123/514
4,783,260 A * 11/1988 Kurihara ..... B01D 35/0273 210/232
4,790,185 A * 12/1988 Fedelem ..... G01F 23/30 137/565.24
4,853,123 A * 8/1989 Hayes ..... B01D 29/111 210/316
4,869,225 A * 9/1989 Nagata ..... F02M 37/106 123/509
4,966,522 A * 10/1990 Koyama ..... F02M 37/50 415/121.2
4,974,570 A * 12/1990 Szwargulski ..... B01D 35/0273 123/509
5,049,267 A * 9/1991 Sasaki ..... B01D 35/0273 210/172.3
5,049,271 A * 9/1991 Cain ..... F02M 37/50 210/250
5,056,492 A * 10/1991 Banse ..... B60K 15/01 123/509
5,111,844 A * 5/1992 Emmert ..... F02M 37/106 123/514
5,120,434 A * 6/1992 Yoshida ..... B01D 29/15 210/172.4
5,146,901 A * 9/1992 Jones ..... F02M 25/0854 123/509
5,169,531 A * 12/1992 Shiraga ..... B01D 29/114 210/460
5,263,458 A * 11/1993 Fujino ..... F02B 37/105 123/514
5,289,810 A * 3/1994 Bauer ..... F02M 37/025 123/510
5,341,842 A * 8/1994 Chih ..... F02M 37/025 123/514
5,395,520 A * 3/1995 Ito ..... B01D 29/15 210/172.4
5,396,872 A * 3/1995 Ruger ..... B60K 15/077 123/514
5,398,659 A * 3/1995 Zimmerman ..... F02M 37/106 123/514
5,415,146 A * 5/1995 Tuckey ..... B01D 35/0273 123/509
5,431,143 A * 7/1995 Brown ..... B60K 15/077 123/514
5,511,957 A * 4/1996 Tuckey ..... B01D 35/0273 417/313
5,547,568 A * 8/1996 Sasaki ..... B01D 29/15 210/172.4
5,613,476 A * 3/1997 Oi ..... B01D 35/0273 123/509
5,639,367 A * 6/1997 Ohzeki ..... B01D 35/0273 210/315
5,642,719 A * 7/1997 Brown ..... F02M 37/106 123/509
5,647,329 A * 7/1997 Bucci ..... B01D 35/0273 123/509
5,649,514 A * 7/1997 Okada ..... B01D 35/26 123/514
5,665,229 A * 9/1997 Fitzpatrick ..... B01D 35/027 210/232
5,702,237 A * 12/1997 Hill ..... B01D 29/114 417/313
5,716,522 A * 2/1998 Chilton ..... B01D 29/111 210/317
5,728,292 A * 3/1998 Hashimoto ..... B01D 29/15 210/136
5,732,684 A * 3/1998 Thompson ..... F02M 37/0052 123/509
5,778,926 A * 7/1998 Tanaka ..... F16L 11/08 137/508
5,782,223 A * 7/1998 Yamashita ..... F02M 37/44 123/510
5,785,032 A * 7/1998 Yamashita ..... B01D 35/027 123/509
5,787,865 A * 8/1998 Harris ..... B01D 35/0273 123/516
5,795,468 A * 8/1998 Reising ..... B01D 29/15 210/172.4
5,809,975 A * 9/1998 Tuckey ..... B01D 35/0273 123/509
5,876,599 A * 3/1999 Sylvester ..... F02M 37/14 210/232
5,900,140 A * 5/1999 Nagai ..... F02M 37/50 210/85
5,900,148 A * 5/1999 Izutani ..... B01D 35/26 210/416.4
5,902,480 A * 5/1999 Chilton ..... F02M 37/50 210/317
6,009,911 A * 1/2000 Friederich ..... F16L 11/08 138/137
6,098,600 A * 8/2000 Umetsu ..... F02M 37/106 123/514
6,123,521 A * 9/2000 Mori ..... F02M 37/50 417/423.3
6,156,201 A * 12/2000 Ueda ..... B01D 35/027 210/416.4
6,176,260 B1 * 1/2001 Hahner ..... B60K 15/077 123/468
6,220,454 B1 * 4/2001 Chilton ..... B01D 29/15 210/483
6,241,883 B1 * 6/2001 Noda ..... B01D 35/027 210/172.3
6,273,131 B1 * 8/2001 Kleppner ..... B01D 35/0273 137/565.22
6,283,731 B1 * 9/2001 Yoshioka ..... B01D 35/0273 417/423.3
6,293,770 B1 * 9/2001 Matsumoto ..... F02M 37/106 417/361
6,308,733 B2 * 10/2001 Murakoshi ..... B60K 15/077 123/509
6,343,589 B1 * 2/2002 Talaski ..... F02M 37/025 123/509
6,361,691 B1 * 3/2002 Dockery ..... B01D 35/027 210/242.1

(56) References Cited

U.S. PATENT DOCUMENTS 6,378,504 B1 * 4/2002 Horiuchi ..... B01D 35/26 123/509
6,382,190 B1 * 5/2002 Tanabe ..... B01D 29/071 123/509
6,412,517 B1 * 7/2002 Flambert ..... B01D 35/0273 137/550
6,464,872 B1 * 10/2002 Honda ..... B01D 35/0273 210/416.4
6,471,072 B1 * 10/2002 Rickle ..... F02M 37/50 210/486
6,471,863 B2 * 10/2002 Kojima ..... B01D 35/0273 210/232
6,513,503 B2 * 2/2003 Iwamoto ..... F02M 37/025 123/509
6,551,509 B2 * 4/2003 Appleton ..... B01D 35/0273 210/416.4
6,613,227 B2 * 9/2003 Rickle ..... B01D 35/0273 210/243
6,638,423 B2 * 10/2003 Dockery ..... B01D 35/0273 210/132
6,739,354 B2 * 5/2004 Oku ..... B01D 35/0273 137/565.22
6,743,355 B2 * 6/2004 Roth ..... B01D 35/0273 210/175
6,821,422 B1 * 11/2004 Brzozowski ..... F02M 37/50 210/416.4
6,830,687 B2 * 12/2004 Dockery ..... B01D 35/0273 210/416.4
6,833,070 B2 * 12/2004 Fischer ..... B01D 35/0273 210/232
6,863,814 B2 * 3/2005 Okabe ..... B01D 35/027 210/416.4
6,913,693 B2 * 7/2005 Unuki ..... F02M 37/50 210/416.4
6,923,164 B1 * 8/2005 Mitsudou ..... F02M 37/50 123/509
6,929,742 B2 * 8/2005 Wehrum ..... B01D 29/117 210/257.1
6,936,168 B2 * 8/2005 Dockery ..... B01D 35/0273 210/416.4
6,939,467 B2 * 9/2005 Deichmann ..... F02M 37/106 210/416.4
6,951,208 B2 * 10/2005 Milton ..... F02M 37/106 123/509
6,964,265 B2 * 11/2005 Iwamoto ..... B01D 35/26 123/510
6,998,043 B2 * 2/2006 Fischer ..... B01D 35/0273 210/232
7,007,677 B2 * 3/2006 Toki ..... B01D 35/0273 123/509
7,069,912 B2 * 7/2006 Yoshioka ..... F02M 37/34 123/509
7,069,913 B1 * 7/2006 Crary ..... F02M 37/0052 123/509
7,077,109 B2 * 7/2006 Lee ..... F02M 37/0029 123/514
7,108,487 B2 * 9/2006 Koba ..... F02M 37/103 417/360
7,112,278 B2 * 9/2006 Yamada ..... B01D 35/0273 210/232
7,117,854 B2 * 10/2006 Schmitt ..... B01D 35/0276 123/509
7,182,869 B2 * 2/2007 Catlin ..... B01D 35/0273 210/416.4
7,191,767 B2 * 3/2007 Schmitt ..... F02M 37/44 123/509
7,198,035 B2 * 4/2007 Kadler ..... B60K 15/077 123/509
7,207,320 B2 * 4/2007 Ikeya ..... F02M 37/14 123/509
7,228,848 B1 * 6/2007 Rangel ..... F02M 37/50 123/509
7,279,095 B2 * 10/2007 Usui ..... B01D 35/0273 210/232
7,306,715 B2 * 12/2007 Kato ..... B01D 35/027 210/136
7,350,509 B2 * 4/2008 Barz ..... F02M 37/025 123/509
7,387,111 B2 * 6/2008 Yu ..... F02M 37/106 123/509
7,429,322 B2 * 9/2008 Fujita ..... F02M 37/50 210/172.4
7,513,243 B2 * 4/2009 Nakagawa ..... B01D 35/027 123/509
7,546,833 B2 * 6/2009 Tomomatsu ..... F02M 37/50 123/509
7,617,991 B2 * 11/2009 Wells ..... F02M 61/165 239/5
7,628,143 B2 * 12/2009 Yamada ..... F02M 37/106 123/509
7,857,143 B2 * 12/2010 Oku ..... F02M 37/14 210/416.4
7,901,572 B2 * 3/2011 Sato ..... B01D 39/1623 210/172.4
7,964,096 B2 * 6/2011 Kimisawa ..... F02M 37/10 210/172.4
8,038,872 B2 * 10/2011 Jokschas ..... B01D 35/18 210/86
8,080,086 B2 * 12/2011 Graber ..... B01D 39/1623 95/59
8,114,278 B2 * 2/2012 Lorente ..... B01D 36/001 210/188
8,137,546 B2 * 3/2012 Ogose ..... B01D 39/1623 210/172.4
8,173,013 B2 * 5/2012 Sato ..... F02M 37/10 210/172.4
8,197,685 B2 * 6/2012 Ribet ..... B01D 25/176 210/230
8,231,779 B2 * 7/2012 Jokschas ..... B01D 35/18 210/86
8,282,819 B2 * 10/2012 Parra Navarrete .... B01D 35/18 210/184
8,372,278 B1 * 2/2013 Nguyen ..... B01D 35/0273 210/172.2
8,460,542 B2 * 6/2013 Oku ..... B01D 35/26 210/172.4
8,496,821 B2 * 7/2013 Ringenberger ..... B01D 29/111 210/232
8,580,111 B2 * 11/2013 Partridge ..... C10G 31/09 210/172.1
8,641,896 B2 * 2/2014 Remacha ..... F02M 37/30 210/184
8,715,497 B2 * 5/2014 Schnipke ..... B01D 35/0273 210/172.2
8,728,308 B2 * 5/2014 Schnipke ..... B01D 35/0273 210/172.2
8,936,008 B2 * 1/2015 Powell ..... F02M 37/50 123/495
9,080,537 B2 * 7/2015 Choi ..... F02M 37/106
9,132,366 B2 * 9/2015 Ueki ..... F02M 37/44
9,151,257 B2 * 10/2015 Jeon ..... F02M 37/103
9,194,343 B2 * 11/2015 Thienel ..... F02M 37/24
9,248,390 B2 * 2/2016 Hudgens ..... F01N 3/2066
9,416,759 B2 * 8/2016 Braun ..... F02M 37/44
9,421,483 B2 * 8/2016 Goll ..... B01D 35/005
9,441,586 B2 * 9/2016 Akagi ..... B01D 35/0273
9,470,193 B2 * 10/2016 Ries ..... B01D 35/0276
9,486,725 B2 * 11/2016 Ries ..... B01D 29/117
9,567,955 B2 * 2/2017 Akagi ..... F02M 37/50
9,816,470 B2 * 11/2017 Nishio ..... F02M 37/10
9,835,152 B2 * 12/2017 Sakai ..... F04C 15/0073
9,841,018 B2 * 12/2017 Sakai ..... F04C 15/06
9,841,019 B2 * 12/2017 Sakai ..... F04C 15/008
9,890,782 B2 * 2/2018 Sakai ..... F04C 2/102
9,957,931 B2 * 5/2018 Kobayashi ..... B01D 35/26
9,982,672 B2 * 5/2018 Sakai ..... F04C 2/102
10,024,283 B2 * 7/2018 Ishitoya ..... B01D 35/0273
10,024,318 B2 * 7/2018 Sakai ..... F04C 2/102
10,029,561 B2 * 7/2018 Tipton ..... B60K 15/077

(56) References Cited

U.S. PATENT DOCUMENTS 10,086,688 B2 * 10/2018 Henry ..... B60K 15/03
10,145,341 B2 * 12/2018 Kim ..... F02M 37/14
10,190,554 B2 * 1/2019 Ishimitsu ..... B01D 61/362
10,260,465 B2 * 4/2019 Hidaka ..... F02M 37/20
10,267,276 B2 * 4/2019 Nishio ..... F02M 37/50
10,350,527 B2 * 7/2019 Kitajima ..... B01D 29/31
10,393,077 B2 * 8/2019 Furuhashi ..... F02M 37/08
10,400,768 B2 * 9/2019 Sakai ..... F02M 37/08
10,436,161 B2 * 10/2019 Kim ..... F02M 37/14
10,463,999 B2 * 11/2019 Washington ..... B01D 35/005
10,508,630 B2 * 12/2019 Szabo ..... B01D 35/005
10,557,468 B2 * 2/2020 Sakai ..... F02M 37/08
10,612,547 B2 * 4/2020 Sakai ..... F04C 2/10
10,753,329 B2 * 8/2020 Hayashi ..... B01D 29/13
10,794,343 B2 * 10/2020 Hayashi ..... F02M 37/106
10,890,146 B2 * 1/2021 Suzuki ..... F02M 37/14
2002/0074270 A1 * 6/2002 Fischerkeller ..... F02M 37/103 210/97
2002/0100717 A1 * 8/2002 Ueda ..... B01D 35/0273 210/116
2002/0153300 A1 * 10/2002 Appleton ..... B01D 35/0273 210/416.4
2003/0042185 A1 * 3/2003 Dockery ..... F02M 37/50 210/132
2003/0111060 A1 * 6/2003 Ito ..... F02M 37/50 123/509
2003/0132156 A1 * 7/2003 Rickle ..... B01D 35/0273 210/416.4
2004/0000516 A1 * 1/2004 Okabe ..... B01D 35/027 210/416.4
2004/0020839 A1 * 2/2004 Kato ..... B01D 35/027 210/232
2004/0037713 A1 * 2/2004 Schelhas ..... F02M 37/46 417/313
2004/0045884 A1 * 3/2004 Roth ..... B01D 35/18 210/184
2004/0129626 A1 * 7/2004 Fischer ..... B01D 35/0273 210/416.4
2004/0140257 A1 * 7/2004 Dockery ..... F02M 37/50 210/416.4
2004/0144705 A1 * 7/2004 Yamada ..... F02M 37/103 210/172.4
2004/0168971 A1 * 9/2004 Sato ..... B01D 35/0273 210/486
2004/0222143 A1 * 11/2004 Kojima ..... F02M 37/50 210/416.4
2004/0251194 A1 * 12/2004 Brzozowski ..... B01D 35/0273 210/416.4
2005/0023201 A1 * 2/2005 Sato ..... B01D 35/0273 210/172.4
2005/0087178 A1 * 4/2005 Milton ..... F02M 37/025 123/509
2005/0087485 A1 * 4/2005 Takahashi ..... F02M 37/106 210/232
2005/0098489 A1 * 5/2005 Fischer ..... F02M 37/50 210/172.3
2005/0115887 A1 * 6/2005 Dockery ..... B01D 35/0273 210/416.4
2005/0150826 A1 * 7/2005 Sato ..... F02M 37/50 210/488
2005/0173329 A1 * 8/2005 Iwamoto ..... B01D 35/26 210/232
2005/0194306 A1 * 9/2005 Barz ..... B60K 15/077 210/416.4
2005/0236321 A1 * 10/2005 Usui ..... B01D 35/26 210/416.4
2005/0274361 A1 * 12/2005 Ikeya ..... F02M 69/54 123/457
2005/0286103 A1 * 12/2005 Yu ..... F02M 37/106 123/509
2006/0070941 A1 * 4/2006 Cline ..... B01D 35/0276 210/416.4
2006/0076287 A1 * 4/2006 Catlin ..... F02M 37/025 210/416.4
2006/0138035 A1 * 6/2006 Izutani ..... F02M 37/44 210/172.3
2006/0180535 A1 * 8/2006 Yu ..... F02M 37/50 210/172.3
2006/0191832 A1 * 8/2006 Richie ..... B01D 29/21 210/171
2006/0266701 A1 * 11/2006 Dickerson ..... B01D 39/1623 210/503
2007/0007187 A1 * 1/2007 Bahl ..... F02M 37/106 210/172.3
2007/0095733 A1 * 5/2007 Pizzo ..... B01D 35/0273 210/172.4
2007/0181102 A1 * 8/2007 Hazama ..... F02M 37/50 123/514
2007/0199546 A1 * 8/2007 Tomomatsu ..... F02M 37/106 123/509
2007/0199884 A1 * 8/2007 Nakagawa ..... B01D 35/0273 210/416.4
2007/0215122 A1 * 9/2007 Nakagawa ..... F02M 37/0029 123/509
2007/0246420 A1 * 10/2007 Sato ..... B01D 35/0273 210/416.4
2008/0127948 A1 * 6/2008 Braun ..... F02M 37/025 123/510
2008/0169033 A1 * 7/2008 Tipton ..... F02M 37/103 137/565.24
2008/0173282 A1 * 7/2008 Briggs ..... F04D 9/06 123/506
2008/0245724 A1 * 10/2008 Oku ..... F02M 37/106 210/416.4
2009/0000844 A1 * 1/2009 Castillo ..... F02M 37/46 180/69.4
2009/0025690 A1 * 1/2009 Yamada ..... F02M 37/50 123/509
2009/0039011 A1 * 2/2009 Sato ..... F02M 37/50 210/491
2009/0050551 A1 * 2/2009 Kimisawa ..... F02M 37/10 210/172.4
2009/0120858 A1 * 5/2009 Kojima ..... F02M 37/50 210/167.08
2009/0188574 A1 * 7/2009 Eck ..... F02M 37/50 137/565.17
2009/0255515 A1 * 10/2009 Eck ..... F02M 37/50 123/509
2009/0321347 A1 * 12/2009 Ogose ..... B01D 35/0273 210/452
2010/0072120 A1 * 3/2010 Sato ..... F02M 37/34 210/172.4
2010/0200518 A1 * 8/2010 Ribet ..... B01D 25/176 210/767
2010/0206793 A1 * 8/2010 Oku ..... B01D 29/114 210/172.4
2010/0307615 A1 * 12/2010 Takahashi ..... F02M 37/50 137/544
2011/0132825 A1 * 6/2011 Nishio ..... B01D 29/13 210/172.4
2011/0139278 A1 * 6/2011 Kawajiri ..... B01D 35/0273 137/565.01
2011/0155658 A1 * 6/2011 Graber ..... B01D 39/1623 210/243
2011/0180469 A1 * 7/2011 Sato ..... F02M 37/34 210/172.4
2011/0192786 A1 * 8/2011 Nagai ..... F02M 37/34 210/443
2011/0233122 A1 * 9/2011 Choi ..... B01D 35/31 210/171
2012/0118401 A1 * 5/2012 Murabayashi ..... B60K 15/077 137/123
2012/0240901 A1 * 9/2012 Yamada ..... F02M 37/44 123/509
2012/0248021 A1 * 10/2012 Schnipke ..... B01D 35/0273 210/232
2013/0061960 A1 * 3/2013 Jeon ..... F02M 37/103 137/544

(56) References Cited

U.S. PATENT DOCUMENTS

2013/0098339 A1* 4/2013 Yoon ..... F02M 37/04 123/495
2013/0161249 A1* 6/2013 Kwon ..... B01D 35/0276 210/232
2013/0206663 A1* 8/2013 Ito ..... B01D 35/0273 210/172.4
2013/0233285 A1* 9/2013 Yamada ..... F02M 37/106 123/514
2014/0096849 A1* 4/2014 Akagi ..... B01D 29/11 137/545
2014/0227082 A1* 8/2014 Ohashi ..... F02M 37/50 415/121.2
2014/0345719 A1* 11/2014 Kim ..... F02M 37/14 137/544
2015/0060349 A1* 3/2015 Ishitoya ..... F02M 37/46 210/416.4
2015/0198071 A1* 7/2015 Hudgens ..... B01D 35/0276 210/805
2016/0108872 A1* 4/2016 Akagi ..... F02M 37/50 210/416.4
2016/0115919 A1* 4/2016 Nishio ..... F02M 37/10 210/416.4
2016/0245246 A1* 8/2016 Niwa ..... F02M 37/44
2016/0298624 A1* 10/2016 Sakai ..... F04C 15/06
2016/0298625 A1* 10/2016 Sakai ..... F04C 2/102
2016/0305425 A1* 10/2016 Sakai ..... F04C 2/086
2016/0305426 A1* 10/2016 Sakai ..... F02M 59/12
2016/0332512 A1* 11/2016 Nakamura ..... B60K 15/03177
2016/0333875 A1* 11/2016 Sakai ..... F04C 15/06
2016/0333878 A1* 11/2016 Sakai ..... F04C 15/0065
2017/0138323 A1* 5/2017 Kobayashi ..... F02M 37/0076
2017/0254302 A1* 9/2017 Takahashi ..... F02M 37/18
2017/0254303 A1* 9/2017 Takahashi ..... F02M 37/0076
2017/0304749 A1* 10/2017 Niwa ..... F02M 37/46
2017/0370338 A1* 12/2017 Sakai ..... F02M 37/10
2018/0010606 A1* 1/2018 Sakai ..... F04C 15/0061
2018/0010607 A1* 1/2018 Sakai ..... F02M 37/08
2018/0038326 A1* 2/2018 Furuhashi ..... F04C 14/10
2018/0087504 A1* 3/2018 Sakai ..... F04C 2/102
2018/0163679 A1* 6/2018 Niwa ..... F02M 37/50
2018/0209386 A1* 7/2018 Hayashi ..... B01D 35/02
2018/0257006 A1* 9/2018 Hayashi ..... F02M 37/44
2018/0306148 A1* 10/2018 Sakai ..... F04C 2/102
2018/0335004 A1* 11/2018 Szabo ..... B01D 35/005
2018/0347526 A1* 12/2018 Ito ..... F02M 37/10
2018/0363607 A1* 12/2018 Hayakawa ..... B01D 35/027
2019/0010905 A1* 1/2019 Hayashi ..... B01D 29/27
2019/0022563 A1* 1/2019 Kobayashi ..... B01D 35/0273
2019/0063383 A1* 2/2019 Kim ..... F02M 37/14
2020/0088145 A1* 3/2020 Villaire ..... F02M 37/22

FOREIGN PATENT DOCUMENTS

JP 2014-152726 8/2014
JP 2017-15052 1/2017

* cited by examiner

FUEL PUMP AND FUEL PUMP MODULE

CROSS REFERENCE TO RELATED APPLICATION

This application is the U.S. national phase of International Application No. PCT/JP2016/084870 filed Nov. 25, 2016, which designated the U.S. and claims priority to Japanese Patent Application No. 2015-246454 filed on Dec. 17, 2015, the entire contents of each of which are incorporated herein by reference.

TECHNICAL FIELD

The present disclosure relates to a fuel pump which is fluidly connected to a suction filter and suctions fuel filtered by the suction filter.

BACKGROUND ART

Conventionally, it has been known that a fuel pump is fluidly connected to a suction filer and suctions fuel filtered by the suction filter. Patent Literature 1 discloses a fuel pump which is provided with a suction port including a single suction opening and a pump connecting portion arranged at outer side of the single suction opening. A suction filter is provided with a filter connecting portion including a cylindrical hole.

In the fuel pump shown in Patent Literature 1, the filter connecting portion is press-fit to the pump connecting portion. An inner peripheral wall of the cylindrical hole of the filter connecting portion is connected to an outer peripheral wall of the pump connecting portion.

The present inventors made a new configuration of a fuel pump in which multiple suction openings are provided to a suction port. If the pump connecting portion and the filter connecting portion are connected to each other with respect to each suction port, a connecting configuration therebetween will be complicated.

The present inventors have studied a configuration where multiple suction openings are unified to be connected and the pump connecting portion is provided at outer side of the multiple suction openings. Then, the inner peripheral wall of the cylindrical hole of the filter connecting portion is connected to the outer peripheral wall of the pump connecting portion.

However, in such a configuration, it is likely that the circumferential length of the inner peripheral wall and the outer peripheral wall relative to the opening area of the suction openings may become longer than a case of a single suction opening. When both connecting portions are expanded due to fuel property or thermal variation, a clearance is easily generated between the inner peripheral wall and the outer peripheral wall. The connection between the fuel pump and the suction filter becomes loose, so that the suction filter may be disconnected.

PRIOR ART LITERATURES

Patent Literature

Patent Literature 1: JP 2014-152726 A

SUMMARY OF INVENTION

It is an object of the present disclosure to provide a fuel pump and a fuel pump module from which a suction filter is hardly disconnected.

According to a first aspect of the present disclosure, a fuel pump is connected to a suction filter which is provided with a filter connecting portion having a cylindrical hole and a projecting portion protruding radially inward from an inner peripheral wall of the cylindrical hole, and the fuel pump suctions a fuel filtered by the suction filter. The fuel pump has a suction port having a plurality of suction openings at a side of the suction filter so as to suction the fuel therethrough, and a pump connecting portion provided at outer side of the multiple suction openings and connected with the filter connecting portion. The pump connecting portion has an outer peripheral wall of which outer shape corresponds with a shape of the inner peripheral wall, and a dent portion dented inward from the outer peripheral wall, which the projecting portion is engaged with.

The fuel pump is connected to the suction filter which is provided with the filter connecting portion having the projecting portion protruding radially inward from the inner peripheral wall of the cylindrical hole. The pump connecting portion of the fuel pump has the dent portion denting from the outer peripheral wall toward the inner peripheral wall so that the projecting portion is engaged therewith. Thus, even if circumferences of the outer peripheral wall and the inner peripheral wall are increased and a clearance is generated between both walls, the projecting portion is engaged with the dent portion so that the fuel pump and the suction filter are hardly disconnected. As above, it is possible to provide the fuel pump from which the suction filter is less disconnected.

According to a second aspect of the present disclosure, a fuel pump module is provided with a suction filter filtering a fuel and a fuel pump suctioning the fuel filtered by the suction filter. The suction filter is provided with a filter connecting portion having a cylindrical hole and a projecting portion protruding radially inward from an inner peripheral wall of the cylindrical hole. The fuel pump is provided with a suction port having a plurality of suction openings at a side of the suction filter so as to suction the fuel therethrough, and a pump connecting portion provided at outer side of the multiple suction openings and connected with the filter connecting portion. The pump connecting portion has an outer peripheral wall which corresponds with the inner peripheral wall, and a dent portion which dents inward from the outer peripheral wall. The projecting portion is engaged with the convex portion so that the fuel pomp and the suction filter are connected with each other.

The fuel pump is connected to the suction filter which is provided with the filter connecting portion having the projecting portion protruding radially inward from the inner peripheral wall of the cylindrical hole. The pump connecting portion of the fuel pump has the dent portion denting inward from the outer peripheral wall so that the projecting portion is engaged therewith. Thus, even if circumferences of the outer peripheral wall and the inner peripheral wall are increased and a clearance is generated between both walls, the fuel pump and the suction filter are less disconnected. As above, it is possible to provide the fuel pump module from which the suction filter is less disconnected.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Figure 1:
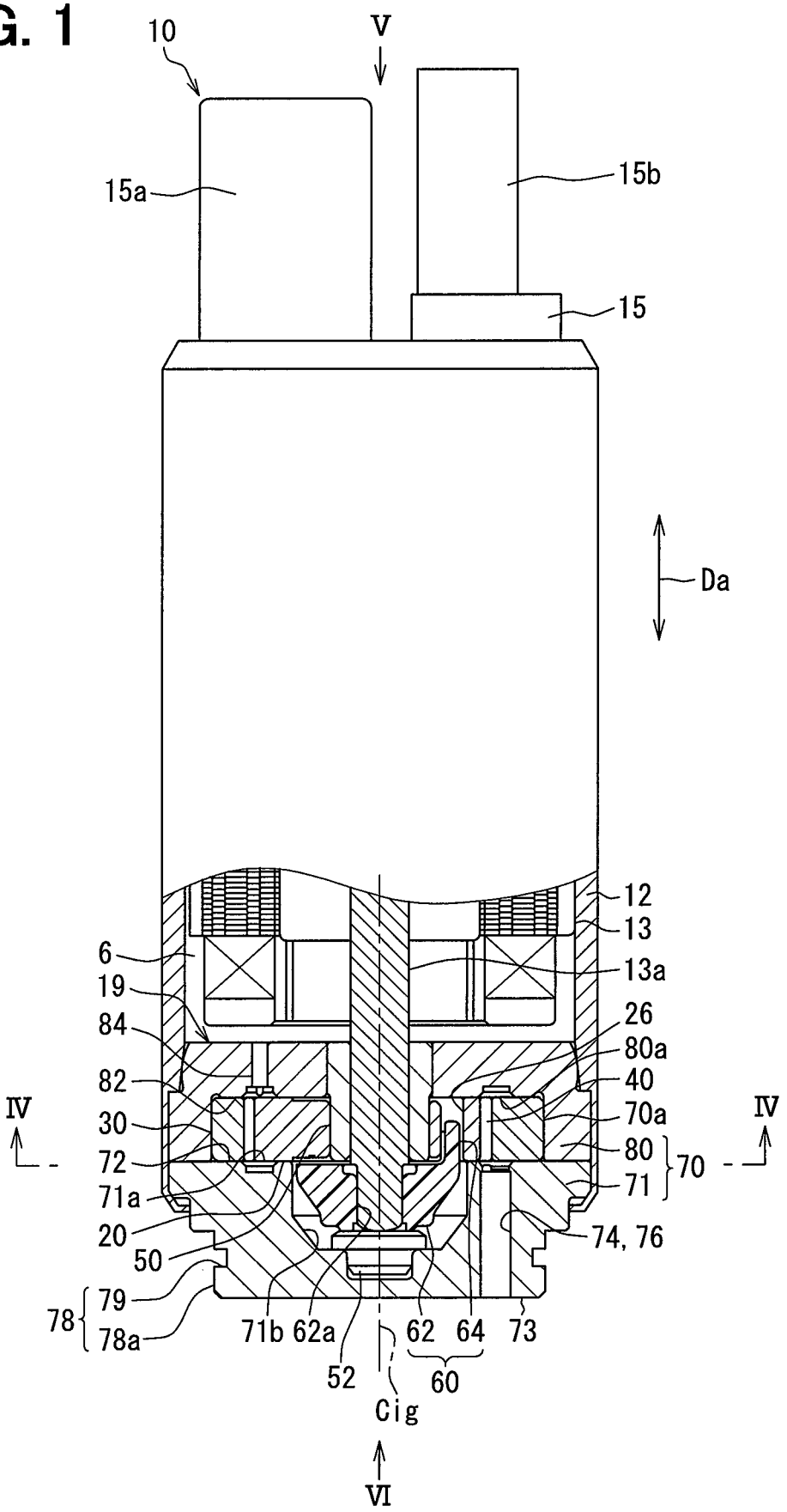
FIG. 1 is a front view partly in section illustrating a fuel pump according to a first embodiment.

Referring to drawings, a plurality of embodiments of the present disclosure will be described, hereinafter. In each embodiment, the same parts and the components are indicated with the same reference numeral and the same description will not be reiterated. In a case where only a part of configuration is explained in each embodiment, a configuration of preceding embodiment can be applied as the other configuration. Moreover, the configuration of each embodiment can be combined with each other even if it is not explicitly described.

First Embodiment

According to a first embodiment of the present disclosure, a fuel pump 10 is a positive displacement trochoid pump, as shown in FIG. 1. The fuel pump 10 is a diesel pump which feeds light oil to an internal combustion engine of a vehicle.

Figure 2:
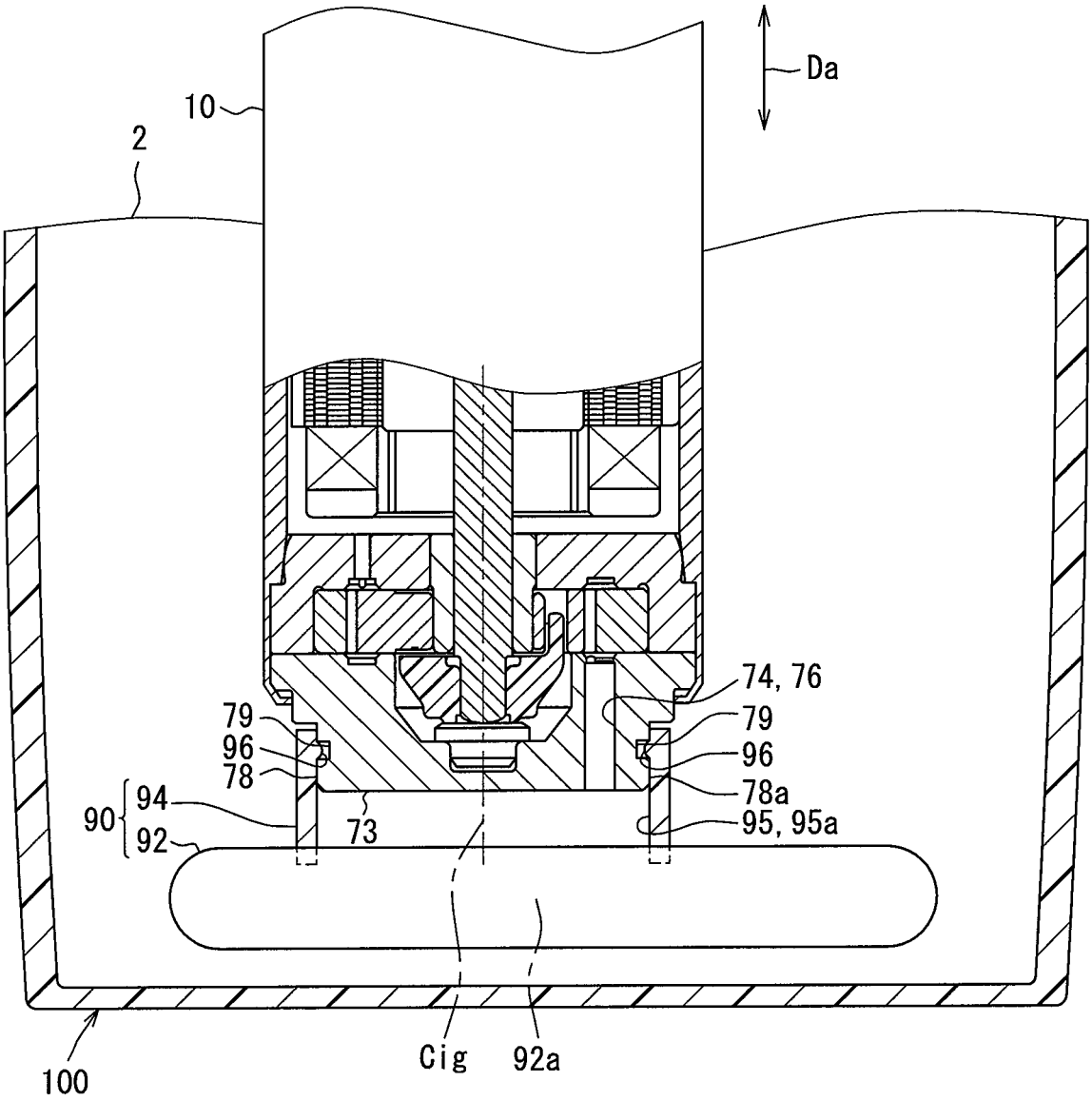
FIG. 2 is a front view partly in section illustrating a fuel pump module according to the first embodiment.

Specifically, as shown in FIG. 2, the fuel pump 10 is disposed in a sub tank 2 of a fuel pump module 100 along with a suction filter 90, which is provided in a fuel tank storing a fuel. The fuel pump module 100 supplies the fuel in the fuel tank to the internal combustion engine.

Figure 3:
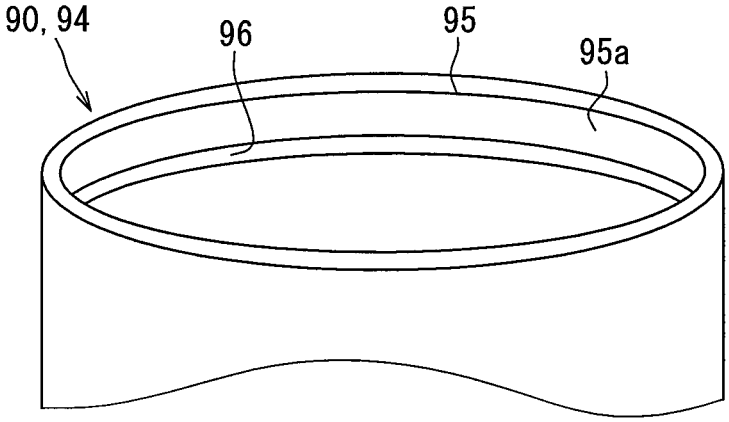
FIG. 3 is a perspective view illustrating a filter connecting portion according to the first embodiment.

As shown in FIGS. 2 and 3, the suction filter 90 is arranged above a bottom portion of the sub tank 2, and is provided with a filter element 92 and a filter connecting portion 94. The filter element 92 is a bag defining an inner space 92*a* therein. The filter element 92 filters the fuel to remove foreign matters, such as sand, duct, and rust, from the fuel. Since light oil has higher viscosity than gasoline and becomes jelly state in a low-temperature condition, the mesh of the filter element 92 is set rougher than a case of gasoline (for example, 100-200 μm).

The filter connecting portion 94 is formed cylindrical as a whole. The filter connecting portion 94 is made from synthetic resins, such as polyphenylene sulfide (PPS) resin or polyacetal (POM) resin. The filter connecting portion 94 has a cylindrical hole 95 and a projecting portion 96. A cylindrical hole 95 has a cylindrical inner surface and one end connected to an inner space 92*a* of the filter element 92. The other end of the cylindrical hole 95 is opened.

The projecting portion 96 inwardly protrudes from an inner peripheral wall 95*a* of the cylindrical hole 95. Especially, according to the first embodiment, the projecting portion 96 is formed annularly. Moreover, the projecting portion 96 protrudes in such a manner that its longitudinal cross section is arc-shaped.

The fuel pump 10, which is connected to the suction filter 90, is provided with an electric motor 13 accommodated by an annular pump body 12, a pump 19, and a side cover 15 which extend in an axial direction Da to cover the electric motor 13 and the pump 19.

The electric motor 13 receives electric power from an external circuit through an electric connector 15*a* provided to the side cover 15, whereby a shaft 13*a* is rotationally driven. An outer gear 30 and an inner gear 20 of the pump 19 are rotated by a driving force of the shaft 13*a*. Thereby, the fuel is introduced into a gear room 70*a* which accommodates both gears 20, 30. The compressed fuel is discharged from an outlet port 15*b* provided to the side cover 15 through a fuel passage 16 defined outside of the gear room 70*a*.

Referring to FIGS. 4 to 8, a configuration and an operation of the fuel pump 10, especially of the pump 19 will be described. The pump 19 is provided with a joint member 60, the inner gear 20, the outer gear 30, and a pump housing 70.

Figure 4:
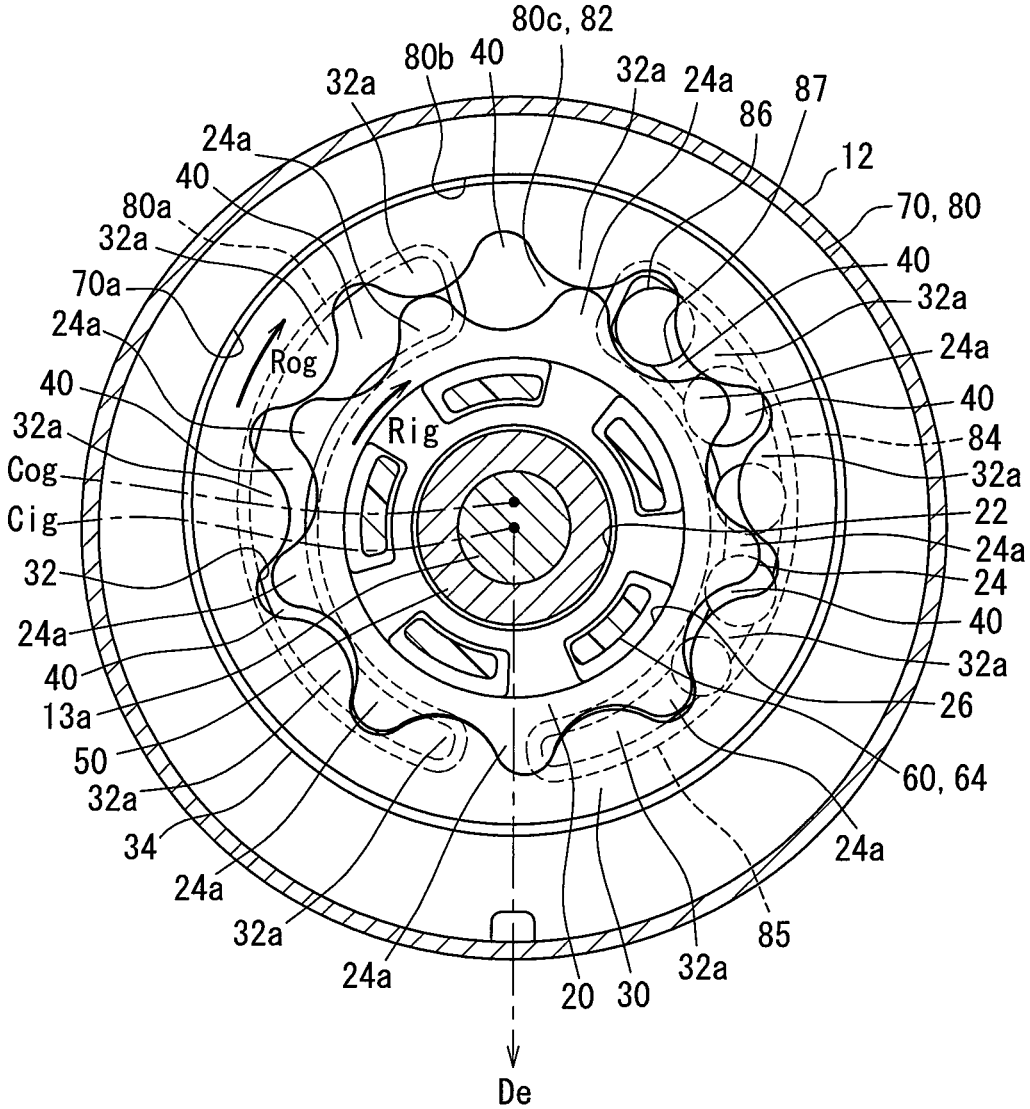
FIG. 4 is a cross sectional view taken along a line IV-IV of FIG. 1.
Figure 5:
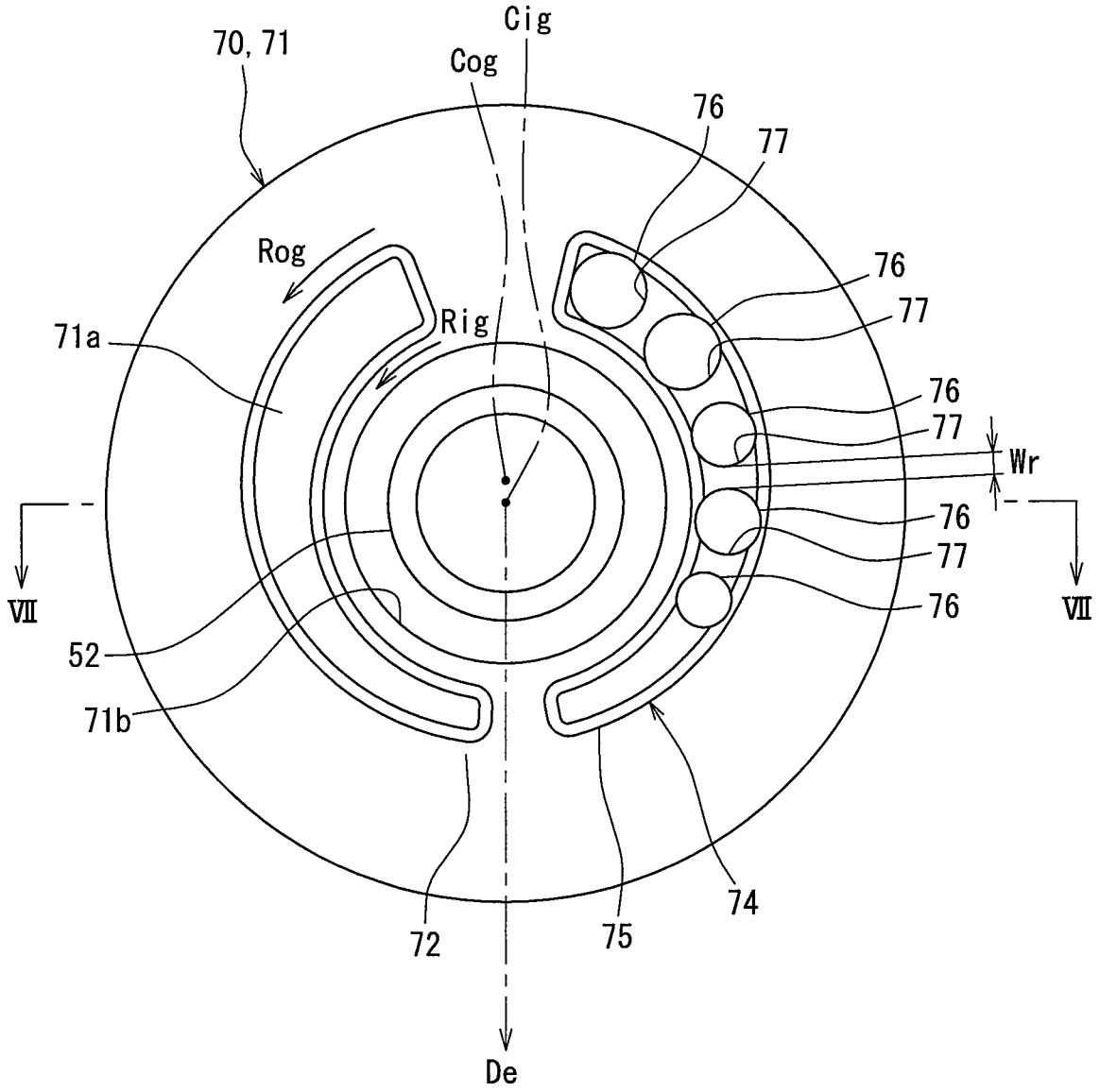
FIG. 5 is a view of a pump cover illustrated in FIG. 1 in a direction of "V".
Figure 6:
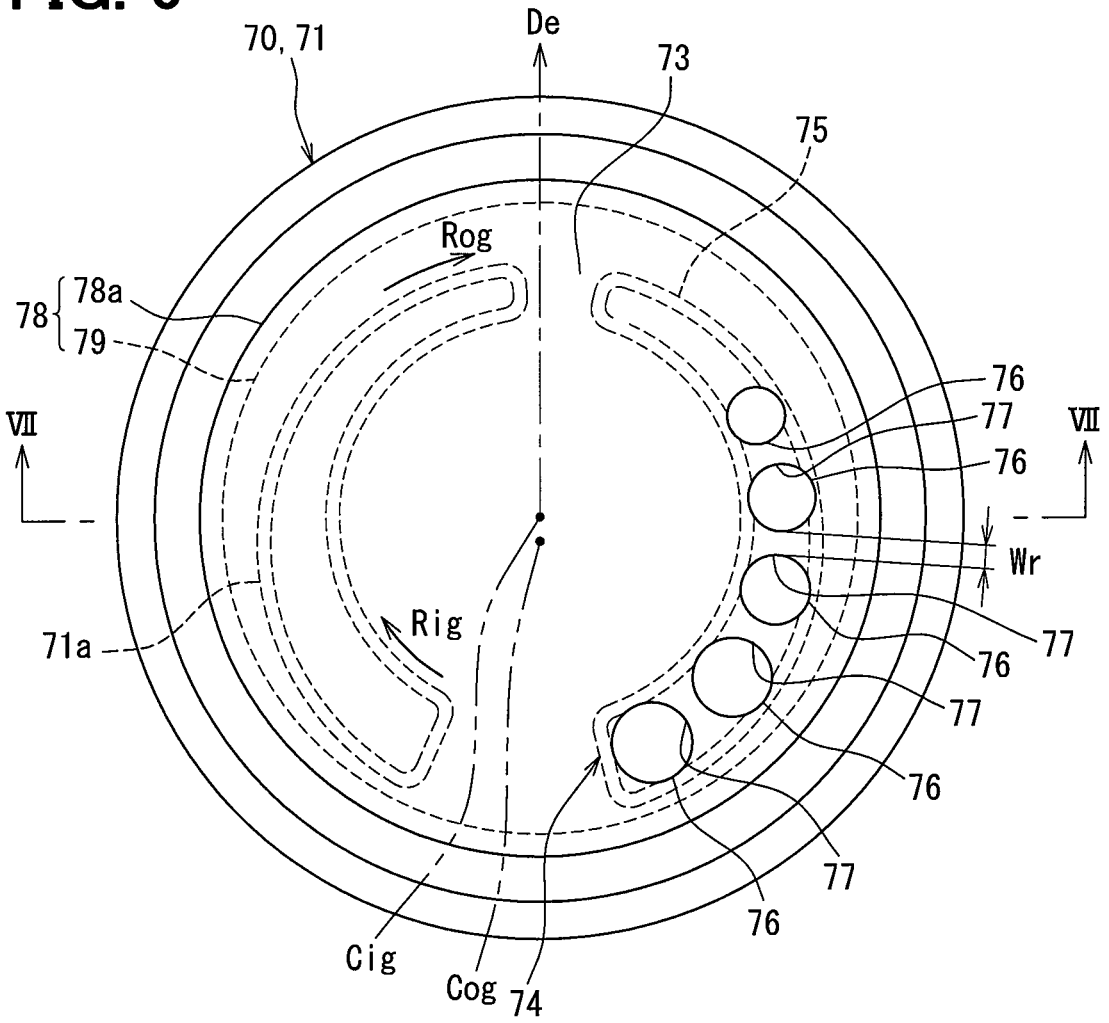
FIG. 6 is a view of a pump cover illustrated in FIG. 1 in a direction of "VI".
Figure 7:
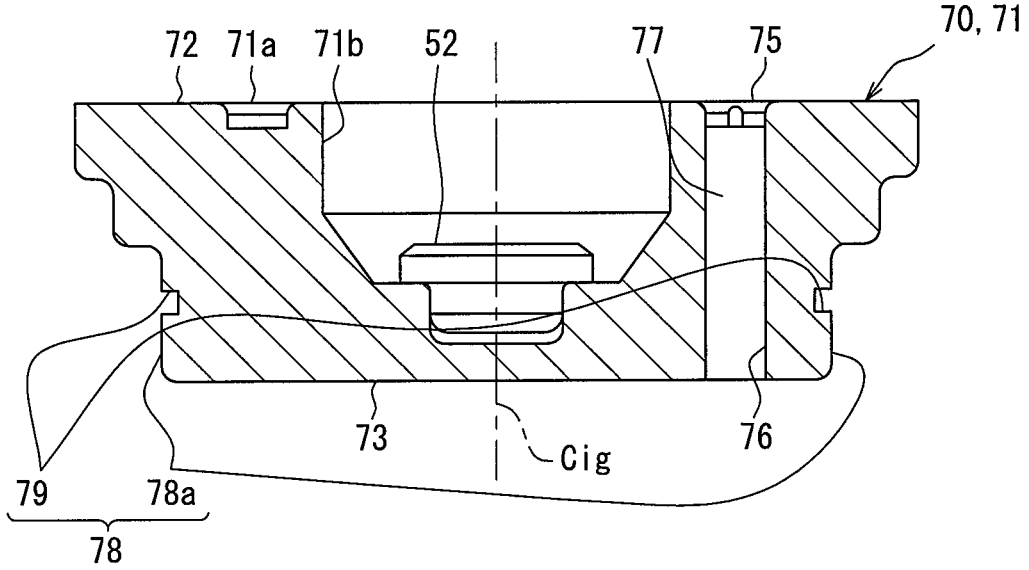
FIG. 7 is a cross sectional view taken along a line VII-VII of FIGS. 5 and 6.

The joint member 60 shown in FIGS. 1 and 4 is made from synthetic resins, such as PPS resin, and connects the shaft 13*a* to the inner gear 20. The joint member 60 has a main body 62 and an insert portion 64. The shaft 13*a* is inserted into an engage hole 62*a* of the main body 62. A plurality of insert portions 64 are formed at regular intervals in a circumferential direction. Each of the insert portions 64 elastically extends to the gear room 70*a* in the axis direction Da around the engage hole 62*a*.

The inner gear 20 shown in FIGS. 1 and 4 is made from metallic material having stiffness, such as ferrous sintered body, for example. The inner gear 20 is a trochoid gear having trochoid-curved gear teeth. An inner-center line Cig passing through a center of the inner gear 20 is aligned with the shaft 13*a*, so that the inner gear 20 is eccentrically arranged in the gear room 70*a*.

The inner gear 20 has an insert hole 26 which faces to the main body 62 of the joint member 60 in the axial direction Da. A plurality of insert holes 26 are formed at regular intervals in a circumferential direction so as to correspond to each of the insert portions 64. Each of the insert holes 26 penetrates the inner gear 20 in the axial direction Da.

Each of the insert portions 64 is inserted into each of the insert holes 26. When the shaft 13*a* is rotationally driven, each of the insert portions 64 abuts on an inner surface of each insert hole 26 and a driving force of the shaft 13*a* is transmitted to the inner gear 20 through the joint member 60. That is, the inner gear 20 can rotate in a rotational direction Rig around the inner-center line Cig. It should be noted that only a part of the insert holes 26 and the insert portions 64 are indicated with numeral references in FIG. 4.

Moreover, as shown in FIG. 4, the inner gear 20 has a plurality of external teeth 24*a* on its outer periphery 24, which are formed at regular intervals in the rotational direction Rig.

The outer gear 30 shown in FIGS. 1 and 4 is made from metallic material having stiffness, such as ferrous sintered body, for example. The inner gear 20 is a trochoid gear having trochoid-curved gear teeth. The outer gear 30 is eccentric to the inner-center line Cig of the inner gear 200 so as to be concentric to the gear room 70*a*. Thus, the inner gear 20 is eccentric to the outer gear 30 in an eccentric direction De which is a radial direction of the outer gear 30.

The outer gear 30 can rotate in a rotational direction Rog around an outer-center line Cog which is eccentric to the inner-center line Cig, along with the inner gear 20. The outer gear 30 has a plurality of internal teeth 32*a* on its inner periphery 32, which are formed at regular intervals in the rotational direction Rog. The number of the internal teeth 32*a* of the outer gear 30 is larger than that of the external teeth 24*a* of the inner gear 20 by one. According to the present embodiment, the number of the internal teeth 32*a* is ten, and the number of the external teeth 24*a* is nine.

The inner gear 20 is eccentric to the outer gear 30 in the eccentric direction De to be engaged with the outer gear 30. Thereby, both gears 20, 30 are engaged with each other in the eccentric direction with less clearance, and a plurality of pump chambers 40 are defined between both gears 20, 30 on anti-eccentric side. When the outer gear 30 and the inner gear 20 rotate with each other, the volume of the pump chamber 40 are increased and decreased. As above, the outer gear 30 and the inner gear 20 configure a rotor portion which rotates in the gear room 70*a* (rotor room).

As shown in FIG. 1, the pump housing 70 defines the gear room 70*a* which rotatably accommodates both gears 20, 30 by confronting a pump cover 71 and the pump casing 80 with each other. Thereby, the pump housing 70 holds the both gears 20, 30 from both end sides in the axial direction Da to define sliding surfaces 72, 82 on which the both gears 20, 30 slide.

The pump cover 71 shown in FIGS. 1, 5 to 7 is one of component parts of the pump housing 70. The pump cover 71 is a disk having abrasion resistance, which is configured by a metallic base member made from steel material with surface treatment, such as plating. The pump cover 71 has a flat projecting surface 73 facing to the suction filter 90 in the axial direction Da.

The pump cover 71 has a joint accommodation chamber 71*b* which accommodates the main body 62 of the joint member 60 at a position facing to the inner gear 20 on the inner-center line Cig. The joint accommodation chamber 71*b* is dented from the sliding surface 72 along the axial direction Da. A thrust bearing 52 fixed at a bottom portion of the joint accommodation chamber 71*b* on the inner-center line Cig in order to support the shaft 13*a* in the axial direction Da.

The pump cover 71 has a suction port 74 through which the fuel is suctioned from an outside of the gear room 70*a* into an inside of the gear room 70*a* at a position outer of the joint accommodation chamber 71*b*. The suction port 74 has a suction extension groove 75 and a plurality of suction openings 76. The suction extension groove 75 is formed on the sliding surface 72 and has an arc shape extending in a circumferential direction of the pump cover 71. For example, five suction openings are formed in an extending direction of the suction extension groove 75. Each of the suction openings 76 penetrates the pump cover 71 in the axial direction Da. One end of each suction opening 76 is opened on a bottom surface of the suction extension groove 75 and the other end is opened at the flat projecting surface 73.

An opening area of the each suction opening 76 is defined according to the volume of the corresponding pump chamber 40. The opening area of the suction opening 76 which is located at anti-eccentric position is defined largest. A stiffening rib 77 for reinforcing the pump cover 71 is formed between adjacent suction openings 76. A width Wr of the stiffening rib 77 is substantially equal to each other between adjacent suction openings 76.

The pump cover 71 has a pump connecting portion 78 facing to the suction filter 90. The pump connecting portion 78 has an outer peripheral wall 78*a* and a dent portion 79 which are located outside of the suction openings 76. The outer peripheral wall 78*a* is cylindrically shaped so as to be fit to an inner peripheral wall 95*a* of the filter connecting portion 94. The dent portion 79 is dented inwardly from the outer peripheral wall 78*a*. Especially, according to the first embodiment, the dent portion 79 is formed annularly. Moreover, a longitudinal section of the dent portion 79 is rectangle of which angle is a right angle. The outer peripheral wall 78*a* and the dent portion 79 are arranged concentrically with the inner-center line Cig of the pump cover 71.

Figure 8:
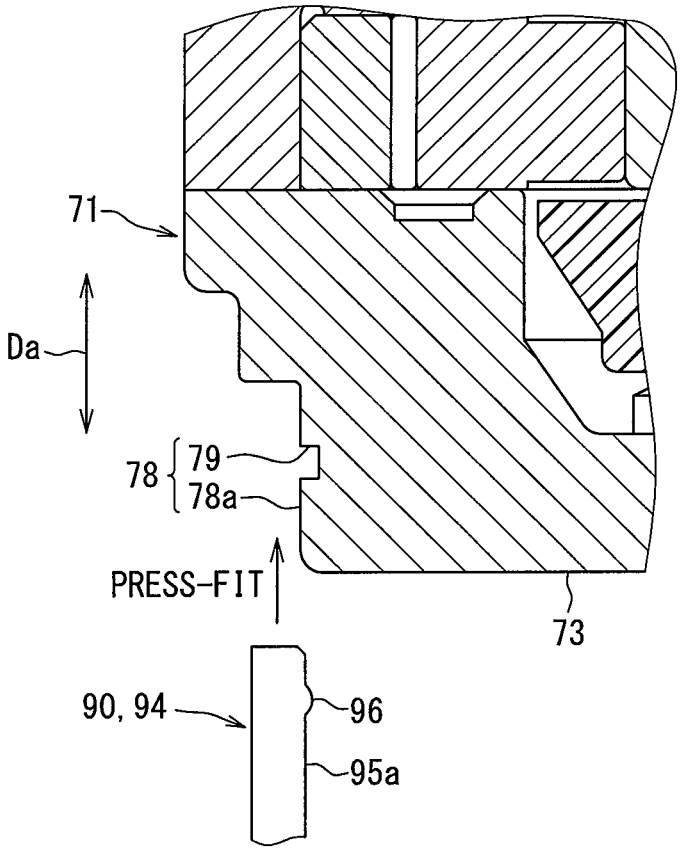
FIG. 8 is a chart for explaining a connection between a fuel pump and a suction filter according to the first embodiment.

When the fuel pump module 100 is assembled, the pump connecting portion 78 is connected to the filter connecting portion 94. Specifically, as shown in FIG. 8, the filter connecting portion 94 is press-fitted to the pump connecting portion 78 along the axial direction Da. The inner peripheral wall 95*a* of the cylindrical hole 95 is in contact with the outer peripheral wall 78*a* circumferentially. The projecting portion 96 is engaged with the dent portion 79 circumferentially. By connecting both connecting portions 78, 94 to each other, each of the suction openings 76 is connected with the inner space 92*a* of the filter element 92 through the cylindrical hole 95.

According to a comparison between materials of the pump cover 71 and the filter connecting portion 94, an expansion coefficient of the pump connecting portion 78 is smaller than that of the filter connecting portion 94. More specifically, a linear expansion coefficient which varies according to a variation in temperature is employed as one of the expansion coefficient. Moreover, a degree of swelling can be employed as another expansion coefficient.

The pump casing 80 shown in FIGS. 1 and 4 is one of component parts of the pump housing 70. The pump casing 80 is a cup having abrasion resistance, which is configured by a metallic base member made from steel material with surface treatment, such as plating. An opening of the pump casing 80 is closed by the pump cover 71. An inner peripheral surface 80*b* of the pump casing 80 is eccentric to the inner-center line Cig, and is concentric with the outer-center line Cog.

A radial bearing 50 is fixed at a bottom portion 80*c* on the inner-center line Cig in order to support the shaft 13*a* which penetrates the bottom portion 80*c*.

The pump casing 80 has a discharge port 84 through which the fuel is discharged from the inside of the gear room 70*a* into the outside of the gear room 70*a* at a position outer of the radial bearing 50. The discharge port 84 has a discharge extension groove 85 and a plurality of discharge openings 86. The discharge extension groove 85 is formed on the sliding surface 82 and has an arc shape extending in a circumferential direction of the pump casing 80. A plurality of discharge openings 86 are formed in an extending direction of the discharge extension groove 85. Each of the discharge openings 86 penetrates the pump casing 80 in the axial direction Da. One end of each discharge opening 86 is opened on a bottom surface of the discharge extension groove 85 and the other end is opened at the fuel passage 16. It should be noted that a part of the discharge openings 86 are indicated with numeral references in FIG. 4.

A suction confront groove 80*a* is formed on the bottom portion 80*c* of the pump casing 80 at a position confronting the suction extension groove 75 of the suction port 74 through the gear room 70*a*. The suction confront groove 80*a* has an arc shape which corresponds to the suction extension groove 75 in the axial direction Da. The suction confront groove 80*a* is dented from the sliding surface 82. In the pump casing 80, the discharge extension groove 85 and the suction confront groove 80*a* are axial symmetric. The sliding surface 82 is positioned between the discharge extension groove 85 and the suction confront groove 80*a*.

A discharge confront groove 71*a* is formed on the pump cover 71 at a position confronting the discharge extension groove 85 of the discharge port 84 through the gear room 70*a*. The discharge confront groove 71*a* has an arc shape which corresponds to the discharge extension groove 85 in the axial direction Da. The discharge confront groove 71*a* is dented from the sliding surface 72. In the pump cover 71, the suction extension groove 75 and the discharge confront groove 71*a* are axial symmetric. The sliding surface 72 is positioned between the suction extension groove 75 and the discharge confront groove 71*a*.

In the gear room 70*a* defined by the pump housing 70, an axial width of the inner gear 20 is slightly smaller than a distance between the sliding surfaces 72 and 82. An inner peripheral surface 22 of the inner gear 20 is radially supported by the radial bearing 50. Both axial end surfaces of the inner gear 20 in the axial direction Da are supported by the sliding surfaces 72, 82.

Moreover, an outer diameter of the outer gear 30 is slightly smaller than an inner diameter of the pump casing 80. An axial width of the outer gear 30 is slightly smaller than the distance between the sliding surfaces 72 and 82. An outer peripheral surface 34 of the outer gear 30 is radially supported by an inner peripheral surface 80*b* of the pump casing 80. Both axial end surfaces of the outer gear 30 in the axial direction Da are supported by the sliding surfaces 72, 82.

Along with rotation of both gears 20, 30, the volume of the pump chamber 40 which communicates with the suction port 74 and the suction confront groove 80*a* is increased. As the result, the fuel is suctioned into the pump chamber 40 in the gear room 70*a* through each of the suction openings 76 of the suction port 74. Since each of the suction openings 76 communicates with the suction extension groove 75 dented from the sliding surface 72, the fuel suctioning is continued while the pump chamber 40 faces to the suction extension groove 75.

Along with rotation of both gears 20, 30, the volume of the pump chamber 40 which communicates with the discharge port 84 and the discharge confront groove 71*a* is decreased. As a result, the fuel in the pump chamber 40 is discharged outside the gear room 70*a* through each of the discharge openings 86 of the discharge port 84. Since each of the discharge openings 86 communicates with the discharge extension groove 85 dented from the sliding surface 82, the fuel discharging is continued while the pump chamber 40 faces to the discharge extension groove 85.

The fuel pump 10 suctions the fuel filtrated by the suction filter 90 through the suction port 74. The fuel is suctioned into the pump chamber 40 in the gear room 70*a* through the suction port 74, and then discharged into a fuel passage 16 through the discharge port 84. The fuel in the fuel passage 16 is discharged outside the fuel pump 10 through the outlet port 15*b*.

(Functions and Effects)

Functions and effects of the first embodiment will be described, hereinafter.

According to the first embodiment, the fuel pump 10 is connected to the suction filter 90 which is provided with the filter connecting portion 94 having the projecting portion 96 protruding radially inward from the inner peripheral wall 95*a* of the cylindrical hole 95. The pump connecting portion 78 of the fuel pump 10 has the dent portion 79 denting from the outer peripheral wall 78*a* so that the projecting portion 96 is engaged therewith. Thus, even if circumferences of the outer peripheral wall 78*a* and the inner peripheral wall 95*a* are increased and a clearance is likely generated between both walls 78*a* and 95*a*, the projecting portion 96 is engaged with the dent portion 79, so that it is restricted that the fuel pump 10 and the suction filter are disconnected from each other. As above, it is possible to provide the fuel pump 10 from which the suction filter 90 is less disconnected.

Moreover, according to the first embodiment, the projecting portion 96 is circumferentially engaged with the dent portion 79. Thus, a contacting area between the projecting portion 96 and the dent portion 79 is enlarged. Even if a clearance is generated between both walls 78*a* and 95*a*, a position aberration is less generated between both connecting portions 78 and 94 in the axial direction Da. A disconnection between the fuel pump 10 and the suction filter 90 is further restricted. It can be restricted that the suction filter 90 is disconnected from the fuel pump 10.

According to the first embodiment, the dent portion 79 has rectangular edges. When the projecting portion 96 is engaged with the dent portion 79, the projecting portion 96 is engaged with rectangular edges, which restricts a disconnection between the fuel pump 10 and the suction filter 90. It can be restricted that the suction filter 90 is disconnected from the fuel pump 10.

Moreover, according to the first embodiment, the pump cover 71 has the pump connecting portion 78 and the multiple suction openings 76. The outer peripheral wall 78*a* and the dent portion 79 of the pump connecting portion 78 are arranged concentrically with the center line of the pump cover 71. According to the above concentric configuration, the dent portion 79 can be easily formed by cutting the pump cover 71 while rotating pump cover 71 around its center axis. Thus, it is possible to provide the fuel pump 10 from which the suction filter 90 is less disconnected.

According to the first embodiment, in the fuel pump module 100, the fuel pump 10 is connected to the suction filter 90 which is provided with the filter connecting portion 94 having the projecting portion 96 protruding radially inward from the inner peripheral wall 95*a* of the cylindrical hole 95. The pump connecting portion 78 of the fuel pump 10 has the dent portion 79 denting from the outer peripheral wall 78*a* so that the projecting portion 96 is engaged therewith. Thus, even if circumferences of the outer peripheral wall 78*a* and the inner peripheral wall 95*a* are increased and a clearance is likely generated between both walls 78*a* and 95*a*, the projecting portion 96 is engaged with the dent portion 79, so that it is restricted that the fuel pump 10 and the suction filter are disconnected from each other. As above, it is possible to provide a fuel pump module in which the suction filter 90 is less disconnected from the fuel pump 10.

Second Embodiment

Figure 9:
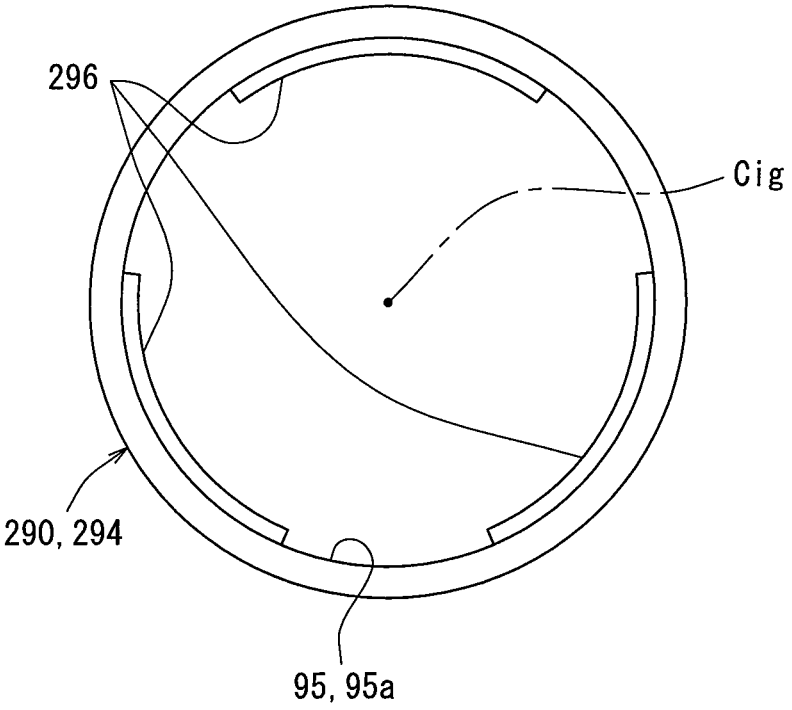
FIG. 9 is a chart illustrating a filter connecting portion according to a second embodiment.

As shown in FIG. 9, a second embodiment of the present disclosure is a modification of the first embodiment. Hereinafter, a second embodiment will be described while focusing on points different from the first embodiment.

In a suction filter 290 of the second embodiment, projecting portions 296 are intermittently formed in a circumferential direction. More specifically, a plurality of projecting portions 296 are formed at regular intervals. According to the present embodiment, the projecting portions 296 are formed at three positions. A total circumferential length of the projecting portions 296 is longer than half of whole circumferential length of the inner peripheral wall 95*a*. Similar to the first embodiment, each of the projecting portions 296 has an arc shaped longitudinal section.

The dent portion 79 is formed at entire perimeter, similar to the first embodiment. Moreover, a longitudinal section of the dent portion 79 is rectangle of which angle is a right angle.

According to the second embodiment, a filter connecting portion 294 is press-fit to the pump connecting portion 78 in the axial direction Da, the inner peripheral wall 95*a* and the outer peripheral wall 78*a* are in contact with each other circumferentially, and the projecting portions 296 is engaged with the dent portion 79.

Since multiple projecting portions 296 are engaged with the dent portion 79, even if a clearance is generated between both walls 78*a* and 95*a*, it can be restricted that the fuel pump 10 and the suction filter 290 are disconnected from each other. It can be restricted that the suction filter 290 is disconnected from the fuel pump 10.

Another Embodiment

While the present disclosure has been described with reference to embodiments thereof, it is to be understood that the disclosure is not limited to the embodiments and constructions. The present disclosure is intended to cover various modification and equivalent arrangements within the spirit and scope of the present disclosure.

Figure 10:
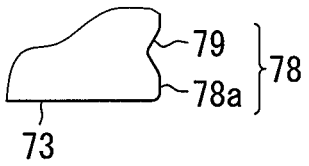
FIG. 10 is a sectional view illustrating a dent portion according to a first modification.

Specifically, according to a first modification, as shown in FIG. 10, the dent portion 79 may have V-shaped longitudinal section.

Figure 11:
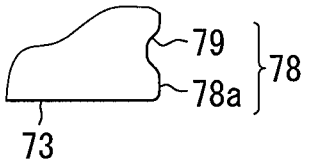
FIG. 11 is a sectional view illustrating a dent portion according to a second modification.

According to a second modification, as shown in FIG. 11, the dent portion 79 may have arc shaped longitudinal section.

Figure 12:
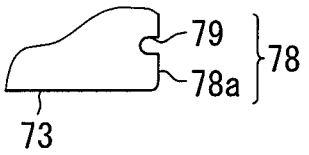
FIG. 12 is a sectional view illustrating a dent portion according to a third modification.

According to a third modification, as shown in FIG. 12, the dent portion 79 may have U-shaped longitudinal section.

According to a fourth modification, a longitudinal section of the dent portion 79 may have an obtuse angle or an acute angle.

According to a fifth modification of the second embodiment, the dent portion 79 may not be always formed at entire circumference. For example, the dent portion 79 may be formed intermittently at positions corresponding to the projecting portions 296.

According to a sixth modification, the outer peripheral wall 78*a* and the dent portion 79 may be arranged eccentric to the center axis (for example, the inner-center line Cig) of the pump cover 71.

According to a seventh modification, the fuel may be gasoline. That is, the fuel pump module 100 may be provided in a fuel tank which stores fuel other than light oil.

The invention claimed is:

1. A fuel pump connected to a suction filter which is provided with a filter connecting portion having a single cylindrical hole and a projecting portion protruding radially inward from an inner peripheral wall of the cylindrical hole, the fuel pump suctioning a fuel filtered by a filter element of the suction filter, the fuel pump comprising:

a suction port having multiple suction openings at a side facing to the suction filter so as to suction the fuel therethrough; and a pump connecting portion provided at outer side of the multiple suction openings and connected with the filter connecting portion; wherein the multiple suction openings being in fluid communication with an inner space of the filter element through the single cylindrical hole, the pump connecting portion has an outer peripheral wall of which outer shape corresponds with a shape of the inner peripheral wall, and a dent portion denting inward from the outer peripheral wall, which the projecting portion is engaged with.

2. The fuel pump according to claim 1, wherein the dent portion is annularly formed on entire circumference of the outer peripheral wall, and the projection portion is annularly formed to be engaged with the dent portion.

3. The fuel pump according to claim 1, wherein the projection portion which is intermittently formed in a circumferential direction is engaged with the dent portion.

4. The fuel pump according to claim 1, wherein the dent portion has an edge which is rectangle.

5. The fuel pump according to claim 1, wherein the pump connecting portion and the multiple suction openings are formed on a same pump component part, and the outer peripheral wall and the dent portion of the pump connecting portion are concentrically formed with respect to a center axis of the pump component part.

6. A fuel pump module comprising:

a suction filter filtering a fuel by means of a filter element: and a fuel pump suctioning the fuel filtered by the suction filter, wherein the suction filter provided with a filter connecting portion having a single cylindrical hole and a projecting portion protruding radially inward from an inner peripheral wall of the cylindrical hole, the fuel pump provided with a suction port having a plurality of suction openings at a side facing to the suction filter so as to suction the fuel therethrough; and a pump connecting portion provided at outer side of the multiple suction openings and connected with the filter connecting portion;

the multiple suction openings being in fluid communication with an inner space of the filter element through the single cylindrical hole, the pump connecting portion has an outer peripheral wall of which outer shape corresponds with a shape of the inner peripheral wall, and a dent portion denting inward from the outer peripheral wall, and the fuel pump and the suction filter are connected with each other in a state where the projecting portion is engaged with the dent portion.

* * * * *